US011196225B2

(12) United States Patent
Fujimoto et al.

(10) Patent No.: US 11,196,225 B2
(45) Date of Patent: Dec. 7, 2021

(54) ROTARY CONNECTOR DEVICE AND FIXED BODY FOR ROTARY CONNECTOR DEVICE

(71) Applicants: FURUKAWA ELECTRIC CO., LTD., Tokyo (JP); FURUKAWA AUTOMOTIVE SYSTEMS INC., Inukami-gun (JP)

(72) Inventors: Kazuki Fujimoto, Inukami-gun (JP); Satoshi Kitao, Inukami-gun (JP); Shingo Nambu, Inukami-gun (JP); Kenji Yoshimura, Inukami-gun (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days.

(21) Appl. No.: 17/023,374

(22) Filed: Sep. 17, 2020

(65) Prior Publication Data

US 2021/0006022 A1 Jan. 7, 2021

Related U.S. Application Data

(63) Continuation of application No. PCT/JP2019/011824, filed on Mar. 20, 2019.

(30) Foreign Application Priority Data

Mar. 30, 2018 (JP) ..... JP2018-069552
Jun. 1, 2018 (JP) ..... JP2018-106005

(51) Int. Cl.
*H01R 3/00* (2006.01)
*H01R 35/04* (2006.01)
(Continued)

(52) U.S. Cl.
CPC ..... *H01R 35/04* (2013.01); *H01R 13/52* (2013.01); *H01R 13/688* (2013.01)

(58) Field of Classification Search
CPC ..... H01R 35/025; B60R 16/027
(Continued)

(56) References Cited

U.S. PATENT DOCUMENTS 8,834,189 B2 * 9/2014 Hirai ..... H01R 35/025 439/164
2008/0268661 A1 10/2008 Mitsui
(Continued)

FOREIGN PATENT DOCUMENTS

CN 102823081 12/2012
CN 103262366 8/2013
(Continued)

OTHER PUBLICATIONS

International Search Report for corresponding International Application No. PCT/JP2019/011824, dated Aug. 13, 2019.
(Continued)

*Primary Examiner* — Phuong Chi Thi Nguyen
(74) *Attorney, Agent, or Firm* — Mori & Ward, LLP

(57) ABSTRACT

A rotary connector device includes a fixed body, a rotation body, and an inhibiting structure. The fixed body includes a first fixed body portion and a second fixed body portion disposed facing each other with a space being defined between the first fixed body portion and the second fixed body portion. The first fixed body portion and the second fixed body portion are coupled at a coupling portion. The rotation body rotatably is assembled to the fixed body. The inhibiting structure is configured to inhibit foreign matter from entering the space through the coupling portion. The coupling portion is exposed to an outer surface of the fixed body.

20 Claims, 11 Drawing Sheets

(51) Int. Cl.
*H01R 13/52* (2006.01)
*H01R 13/688* (2011.01)

(58) Field of Classification Search
USPC ..... 439/164, 15
See application file for complete search history.

(56) References Cited

U.S. PATENT DOCUMENTS

| | | | | |
|---|---|---|---|---|
| 2013/0095672 | A1 | 4/2013 | Hirai | |
| 2013/0095680 | A1* | 4/2013 | Hirai | H01R 13/60 439/164 |
| 2014/0011374 | A1 | 1/2014 | Adachi | |
| 2014/0235082 | A1* | 8/2014 | Adachi | B60R 16/027 439/164 |
| 2019/0089109 | A1 | 3/2019 | Hirai et al. | |
| 2019/0131749 | A1 | 5/2019 | Utsunomiya et al. | |

FOREIGN PATENT DOCUMENTS

| | | |
|---|---|---|
| CN | 204333541 U | 5/2015 |
| CN | 106972310 | 7/2017 |
| JP | 2011-018618 | 1/2011 |
| JP | 3175246 U | 4/2012 |
| JP | 3183930 U | 6/2013 |
| JP | 2013-191437 | 9/2013 |
| JP | WO 2017/170752 | 10/2017 |
| WO | WO 2017/221820 | 12/2017 |

OTHER PUBLICATIONS

Written Opinion for corresponding International Application No. PCT/JP2019/011824, dated Oct. 15, 2020.

Extended European Search Report for corresponding EP Application No. 19776607.4-1201, dated Dec. 16, 2020.

European Office Action for corresponding EP Application No. 19776607.4-1201, dated Sep. 23, 2021.

Chinese Office Action for corresponding CN Application No. 201980018459.5, dated May 27, 2021 (w/ English machine translation).

* cited by examiner

ROTARY CONNECTOR DEVICE AND FIXED BODY FOR ROTARY CONNECTOR DEVICE

CROSS-REFERENCE TO RELATED APPLICATIONS

The present application is a continuation application of International Application No. PCT/JP2019/011824, filed Mar. 20, 2019, which claims priority to Japanese Patent Application No. 2018-069552 filed Mar. 30, 2018 and Japanese Patent Application No. 2018-106005 filed Jun. 1, 2018. The contents of these applications are incorporated herein by reference in their entirety.

BACKGROUND OF THE INVENTION

Technical Field

The technology disclosed in the present application relates to a rotary connector device and a fixed body for the rotary connector device.

Background Art

A known rotary connector device includes a fixed body, a rotation body rotatably attached to the fixed body, a fixed body-side connector, and a rotation body-side connector (for example, see WO 2017/221820). The rotary connector device disclosed in WO 2017/221820 further includes a cable conductor wire that is housed in a space between the fixed body and the rotation body and that electrically connects the fixed body-side connector and the rotation body-side connector.

More specifically, the fixed body disclosed in WO 2017/221820 is a stator main body and a sub-stator that are coupled together to form a space therebetween. In this rotary connector device, foreign matter may enter the space between the stator main body and the sub-stator to degrade performance of the rotary connector device.

SUMMARY

According to one aspect of the present application, a rotary connector device includes a fixed body, a rotation body, and an inhibiting structure. The fixed body includes a first fixed body portion and a second fixed body portion disposed facing each other with a space being defined between the first fixed body portion and the second fixed body portion. The first fixed body portion and the second fixed body portion are coupled at a coupling portion. The rotation body is rotatably assembled to the fixed body. The inhibiting structure is configured to inhibit foreign matter from entering the space through the coupling portion. The coupling portion is exposed to an outer surface of the fixed body.

According to another aspect of the present application, a fixed body for a rotary connector device includes a first fixed body portion, a second fixed body portion, and an inhibiting structure. The second fixed body portion is disposed facing the first fixed body portion with a space being defined between the second fixed body portion and the first fixed body portion and coupled to the first fixed body portion at a coupling portion. The inhibiting structure is configured to inhibit foreign matter from entering the space through the coupling portion. The coupling portion is exposed to outer surfaces of the first fixed body portion and the second fixed body portion. The first fixed body portion and the second fixed body portion are connected to a rotation body rotatably assembled to the first fixed body portion and the second fixed body portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
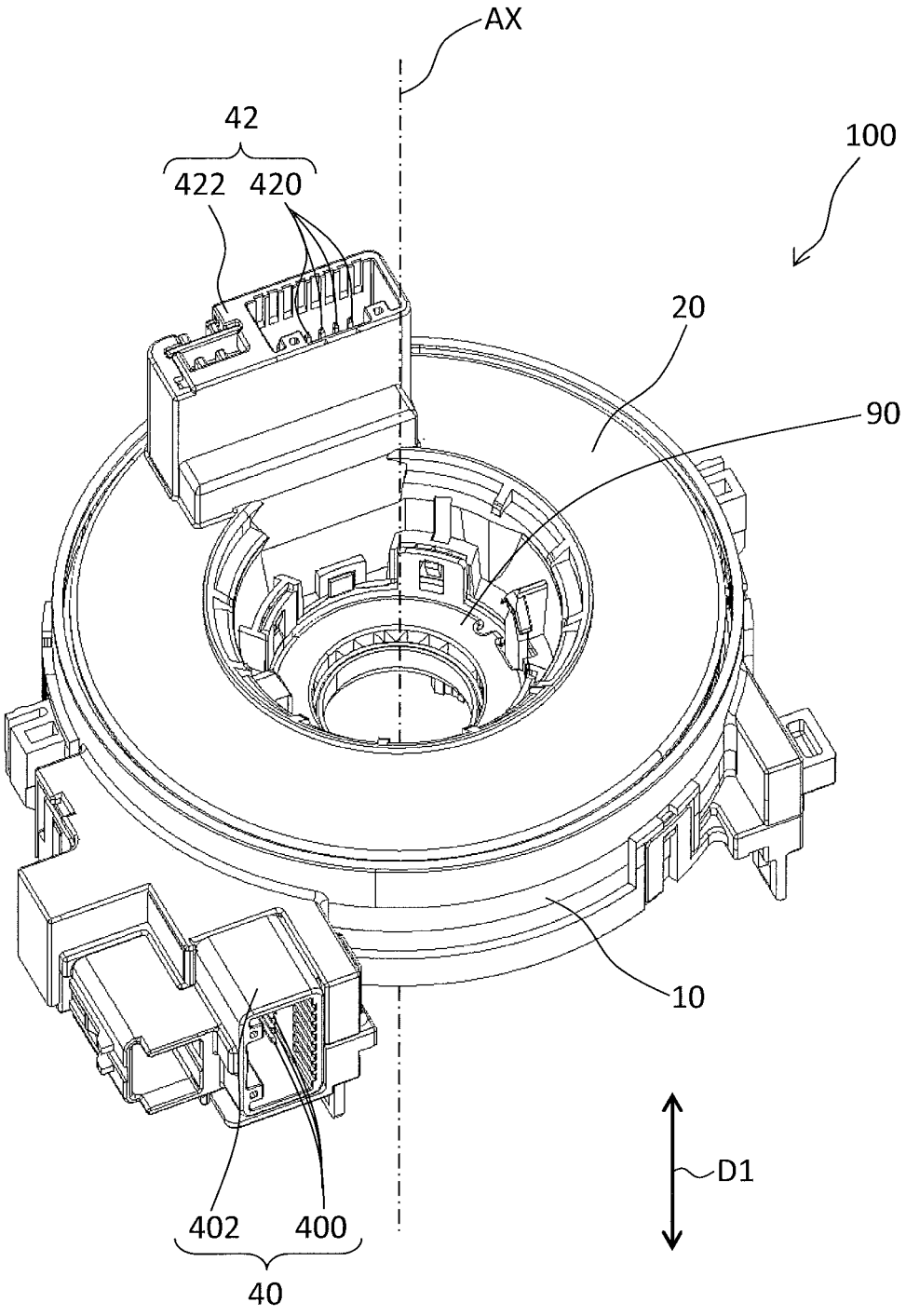
FIG. 1 is a perspective view of a rotary connector device according to a first embodiment.

Next, embodiments will be described while referring to the drawings. The same reference numerals in the drawings indicate corresponding or identical configurations.

First Embodiment

Configuration of Rotary Connector Device

Figure 2:
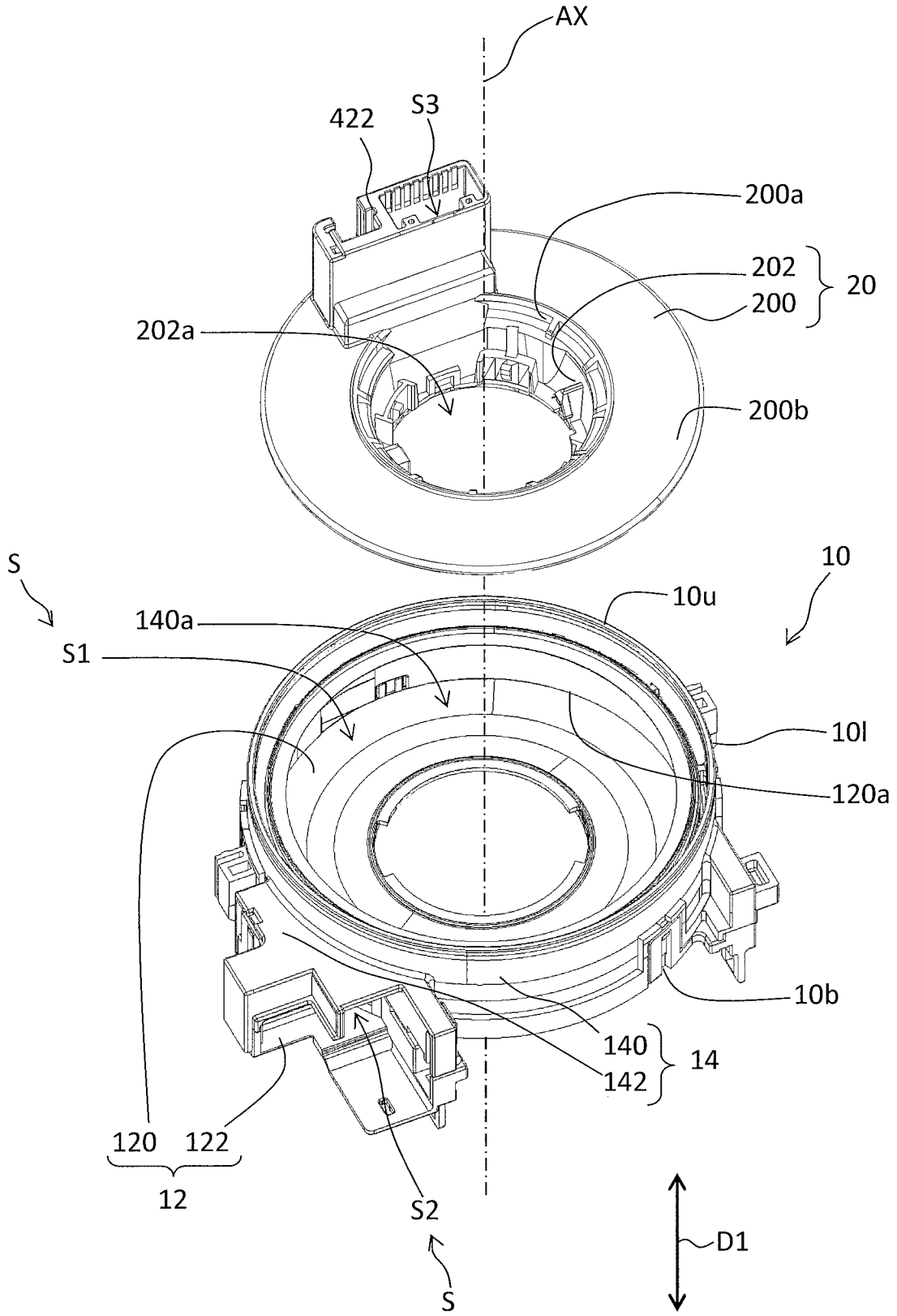
FIG. 2 is an exploded perspective view of a fixed body removed from a rotation body.

FIG. 1 is a perspective view of a rotary connector device 100 according to a first embodiment. FIG. 2 is an exploded perspective view of a fixed body 10 removed from a rotation body 20.

As illustrated in FIGS. 1 and 2, the rotary connector device 100 includes the fixed body 10 and the rotation body 20. The rotation body 20 is assembled to the fixed body 10 so as to be rotatable about a rotation axis AX with respect to the fixed body 10. When the rotation body 20 is assembled to the fixed body 10, a first space S1 is defined between the fixed body 10 and the rotation body 20.

Figure 3:
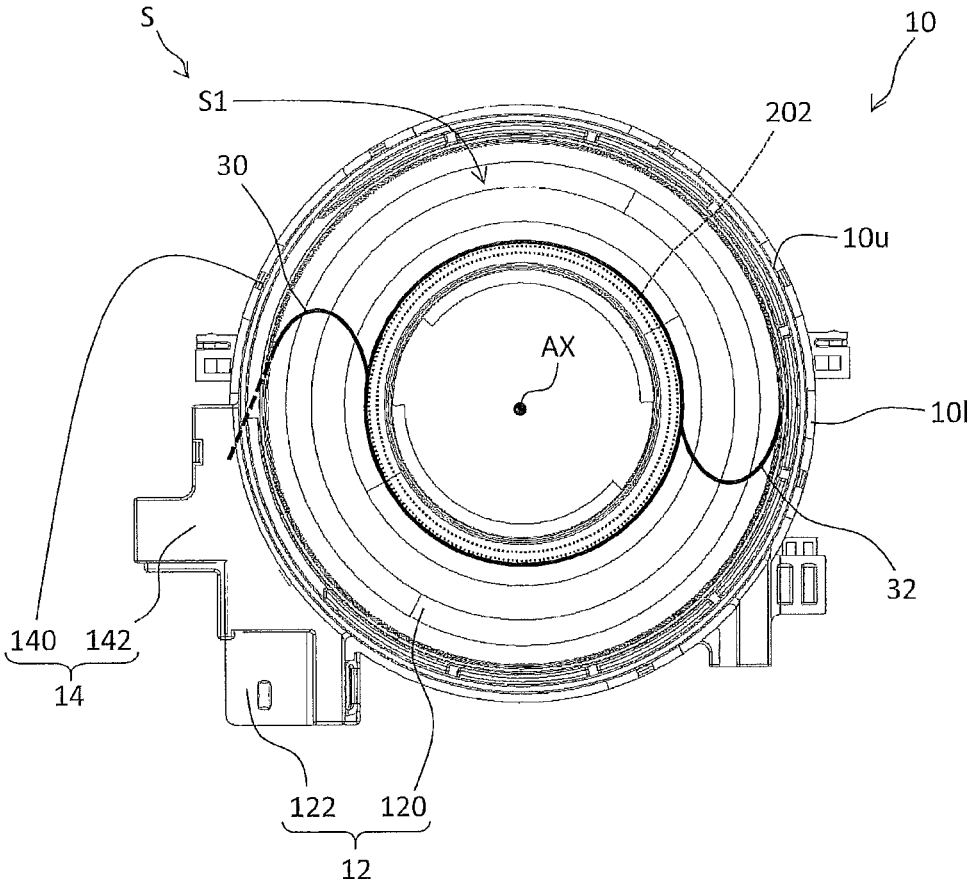
FIG. 3 is a top view of the fixed body for describing the arrangement of cables.

FIG. 3 is a diagram illustrating an upper surface 10*u* of the fixed body 10 and for describing the arrangement of a cable 30 and a cable 32. As illustrated in FIG. 3, the cable 30 and the cable 32 are disposed in the first space S1. A cable conductor wire 34 of the cable 30 (see FIGS. 4 and 7) has a first end connected to the fixed body 10 and a second end connected to the rotation body 20. The cable conductor wire 34 of the cable 32 has a first end connected to the fixed body 10 and a second end connected to the rotation body 20. With the cable 30 and the cable 32 connected to the fixed body 10 and the rotation body 20, the rotation body 20 can rotate about the rotation axis AX with respect to the fixed body 10. The number of cables provided in the rotary connector device 100 is not limited to two. The number of cables may be an even number, for example, four. In addition, the number of cables may be an odd number, for example, three.

The rotary connector device 100 is used in, for example, a movable body (for example, an automobile) including a main body and a steering unit that is rotatable with respect to the main body. Specifically, the fixed body 10 is attached to the main body of the movable body. The rotation body 20 is attached to the steering unit. The first end of the cable conductor wire 34 of the cable 30 and the first end of the cable conductor wire 34 of the cable 32 are electrically connected to an electronic device provided in the main body of the movable body. The second end of the cable conductor wire 34 of the cable 30 and the second end of the cable conductor wire 34 of the cable 32 are electrically connected to an electronic device (for example, a switch) provided in the steering unit. With this configuration, the rotary connector device 100 transmits/receives power or electrical signals to/from the electronic device provided in the main body of the movable body and the electronic device provided in the steering unit. The rotary connector device 100 may be used in a device other than a movable body.

Configuration of Fixed Body

As illustrated in FIGS. 2 and 3, the fixed body 10 is provided with a first fixed body portion 12 and a second fixed body portion 14. The second fixed body portion 14 is coupled to the first fixed body portion 12 with the second fixed body portion 14 disposed above the first fixed body portion 12. The first fixed body portion 12 forms a bottom portion 10*b* of the fixed body 10. The second fixed body portion 14 forms a side wall 101 of the fixed body 10.

As illustrated in FIGS. 2 and 3, the first fixed body portion 12 includes a first ring portion 120 and a first extending portion 122. The first ring portion 120 has a ring shape when the rotary connector device 100 is viewed in a first direction D1 along the rotation axis AX. The first ring portion 120 is disposed such that the rotation axis AX passes through the center of the first ring portion 120. The first extending portion 122 extends outward of an outer periphery 120*a* of the first ring portion 120 in the radial direction of the rotation axis AX.

The second fixed body portion 14 includes an outer-circumferential cylindrical portion 140 and a second extending portion 142. The outer-circumferential cylindrical portion 140 is disposed such that a hollow portion 140*a* of the outer-circumferential cylindrical portion 140 extends in the first direction D1. The outer-circumferential cylindrical portion 140 extends upward from the outer periphery 120*a* of the first ring portion 120 in the first direction D1.

The second extending portion 142 extends outward from the outer-circumferential cylindrical portion 140 in the radial direction of the rotation axis AX. The second extending portion 142 faces the first extending portion 122 in the first direction D1. Details of coupling between the first extending portion 122 and the second extending portion 142 are described later.

Configuration of Rotation Body

As illustrated in FIG. 2, the rotation body 20 includes a second ring portion 200 and an inner-circumferential cylindrical portion 202. The second ring portion 200 has a ring shape when the rotary connector device 100 is viewed in the first direction D1. The second ring portion 200 is disposed such that the rotation axis AX passes through the center of the second ring portion 200. The inner-circumferential cylindrical portion 202 is disposed such that a hollow portion 202*a* of the inner-circumferential cylindrical portion 202 extends in the first direction D1. The inner-circumferential cylindrical portion 202 extends downward from an inner periphery 200*a* of the second ring portion 200 in the first direction D1. The inner-circumferential cylindrical portion 202 is disposed inward of the outer-circumferential cylindrical portion 140 in the radial direction of the rotation axis AX. With this configuration, the first space S1 is defined by the first ring portion 120, the outer-circumferential cylindrical portion 140, the second ring portion 200, and the inner-circumferential cylindrical portion 202. That is, the first ring portion 120, the outer-circumferential cylindrical portion 140, the second ring portion 200, and the inner-circumferential cylindrical portion 202 face each other to define the first space S1. In other words, the first space S1 is equal to a space in which the hollow portion 202*a* of the inner-circumferential cylindrical portion 202 is excluded from the hollow portion 140*a* of the outer-circumferential cylindrical portion 140. Note that the first space S1 is included in a space S between the first fixed body portion 12 and the second fixed body portion 14.

The inner-circumferential cylindrical portion 202 is engaged with an assembly member 90 (see FIG. 1). The assembly member 90 is disposed below the fixed body 10 in the first direction D1 and is rotatable about the rotation axis AX. The rotation body 20 is assembled to the fixed body 10 such that the rotation body 20 and the assembly member 90 sandwich the fixed body 10 in the first direction D1. Note that the assembly member 90 may be omitted.

In the present embodiment, the inner-circumferential cylindrical portion 202 is provided in the rotation body 20. However, to define the first space S1, the inner-circumferential cylindrical portion 202 may be provided in the fixed body 10.

In the present embodiment, the rotary connector device 100 has a shape including the hollow portion 202*a*, but the rotary connector device 100 need not include the hollow portion 202*a*.

Configuration of Connector

As illustrated in FIG. 1, the rotary connector device 100 includes a first connector 40 and a second connector 42. The first connector 40 is connected to an external cable extending from the main body of a movable body, for example. The second connector 42 is connected to an external cable extending from the steering unit of a movable body, for example. The first connector 40 and the second connector 42 are electrically connected via the cable 30 and the cable 32.

The first connector 40 is connected to the fixed body 10. In the present embodiment, the first connector 40 is disposed outward of the fixed body 10 in a direction orthogonal to the first direction D1. However, the first connector 40 may be located below the fixed body 10 or above the fixed body 10. Thus, in the present embodiment, the first connector 40 is disposed outside the space S. However, the first connector 40 may be partially disposed inside the space S.

The first connector 40 includes a plurality of first terminals 400 and a first cover 402. The plurality of first terminals 400 are electrically connected to terminals of the external cable. The first cover 402 is connected to the first extending portion 122 and the second extending portion 142. The first cover 402 covers the plurality of first terminals 400 so as to open on a side opposite to the first extending portion 122 and the second extending portion 142 in a direction orthogonal to the rotation axis AX.

The second connector 42 is disposed on the rotation body 20. However, the position of the second connector 42 is not limited to the position illustrated in FIG. 1. The second connector 42 is connected to the rotation body 20. The second connector 42 includes a plurality of second terminals 420 and a second cover 422. The plurality of second terminals 420 are electrically connected to an external cable. The second cover 422 is connected to an upper surface 200*b* of the second ring portion 200. The second cover 422 covers the plurality of second terminals 420 such that an upper portion of the second cover 422 is open. In the present embodiment, the second connector 42 is disposed outside the space S. However, the second connector 42 may be partially disposed inside the space S.

Configuration of Cable

Figure 4:
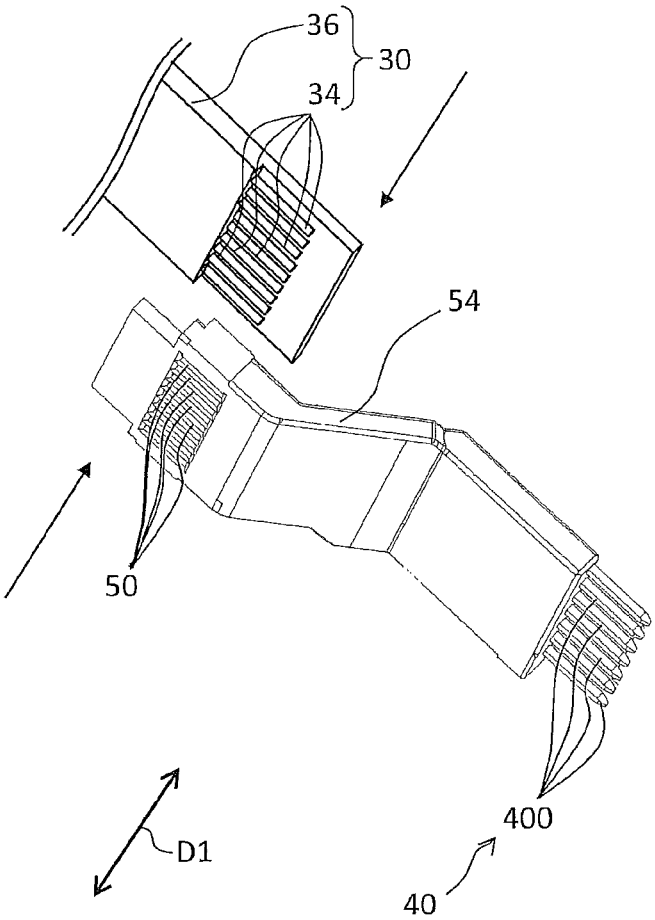
FIG. 4 is a perspective view of a cable and a first connector for describing connection between the cable and the first connector.

FIG. 4 is a perspective view of the cable 30 and the first connector 40 for describing connection between the cable 30 and the first connector 40. However, the first cover 402 is omitted from FIG. 4. Further, because the cable 32 has substantially the same configuration as the cable 30, the cable 32 is also omitted from FIG. 4.

The cable 30 and the cable 32 each have a flat shape. The cable 30 and the cable 32 are both flexible. The cable 30 and the cable 32 each include a plurality of the cable conductor wires 34 and an insulating covering member 36 that covers the plurality of cable conductor wires 34. As illustrated in FIG. 3, the cable 30 and the cable 32 are wound along the outer peripheral surface of the inner-circumferential cylindrical portion 202 and the inner peripheral surface of the outer-circumferential cylindrical portion 140 in the first space S1. As illustrated in FIG. 3, the cable 30 and the cable 32 are both wound in a direction that reverses partway.

The cable 30 passes through a hole formed in the outer-circumferential cylindrical portion 140 such that a first end of the cable 30 is located in a second space S2 (see FIG. 2) surrounded by the first extending portion 122 and the second extending portion 142. The cable 30 passes through a hole formed in the second ring portion 200 such that a second end of the cable 30 is located in a third space S3 (see FIG. 2) covered by the second cover 422.

Configuration of Connection Conductor

As illustrated in FIG. 4, the rotary connector device 100 includes a plurality of connection conductors 50 and an insulating supporting body 54. The plurality of connection conductors 50 are provided for electrically connecting the plurality of cable conductor wires 34 of the cable 30 and the plurality of first terminals 400. The insulating supporting body 54 supports the plurality of connection conductors 50 and the plurality of first terminals 400 of the first connector 40. The insulating supporting body 54 is attached to at least one of the first extending portion 122 and the second extending portion 142 in the second space S2.

Each of the plurality of connection conductors 50 is electrically connected to each of the plurality of first terminals 400. As illustrated in FIG. 4, first ends of the plurality of cable conductor wires 34 of the cable 30 are connected to the plurality of connection conductors 50, respectively. The plurality of first ends of the plurality of cable conductor wires 34 and the plurality of connection conductors 50 are connected to each other by welding. However, the plurality of first ends of the plurality of cable conductor wires 34 and the plurality of connection conductors 50 may be connected to each other by a method other than welding. For example, the plurality of first ends of the plurality of cable conductor wires 34 and the plurality of connection conductors 50 may be crimped by using a cover member. Each of the plurality of first ends of the plurality of cable conductor wires 34 of the cable 32 are connected to each of the plurality of connection conductors 52 supported by an insulating supporting body 56 (see FIG. 7).

Each of the plurality of second ends of the plurality of cable conductor wires 34 of the cable 30 is electrically connected to each of the plurality of second terminals 420 of the second connector 42. Each of the plurality of second ends of the cable conductor wires 34 of the cable 32 is electrically connected to each of the plurality of second terminals 420 of the second connector 42.

Note that the number of connection conductors 50 and the number of cable conductor wires 34 are not limited to the example illustrated in FIG. 4. The rotary connector device 100 may include only one connection conductor 50. The rotary connector device 100 may include only one cable conductor wire 34.

Coupling of Fixed Body

Figure 5:
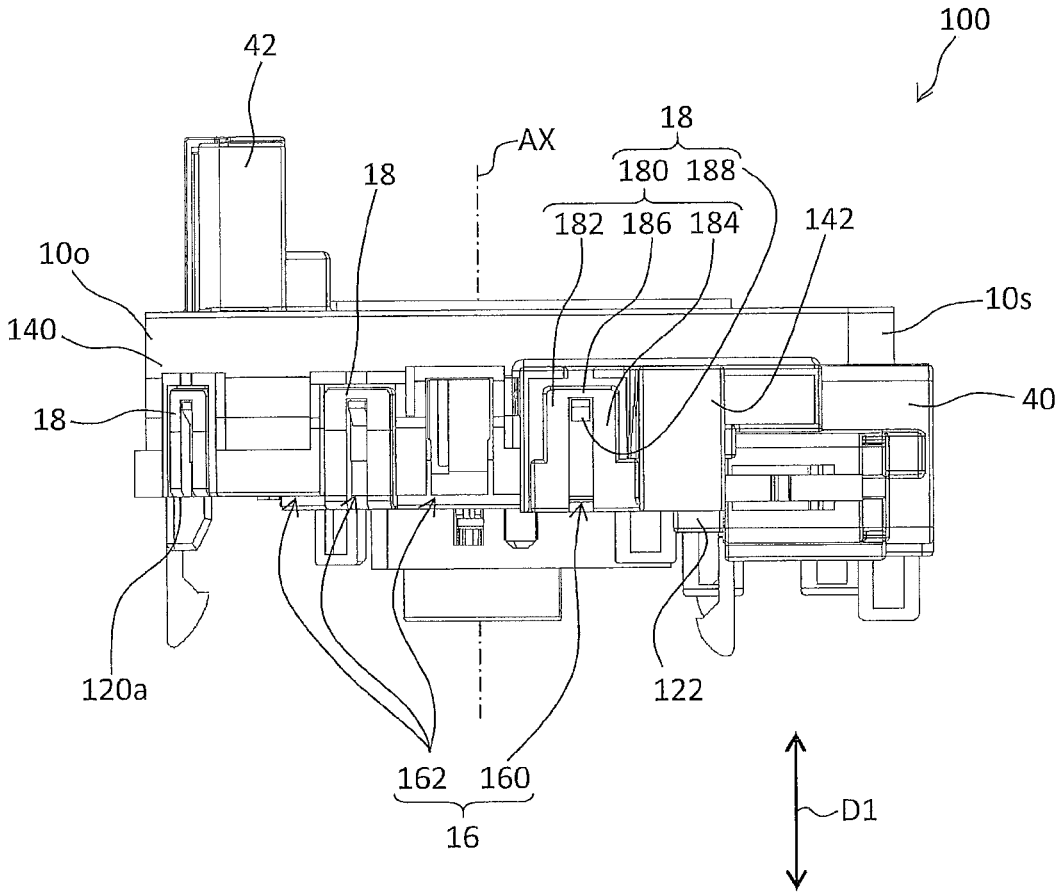
FIG. 5 is a side view of the rotary connector device.

FIG. 5 is a side view of the rotary connector device 100. As illustrated in FIG. 5, the first fixed body portion 12 and the second fixed body portion 14 are coupled together at a coupling portion 16. The coupling portion 16 is exposed to an outer surface 10*s* of the fixed body 10. The outer surface 10*s* of the fixed body 10 includes the outer surfaces of at least the first ring portion 120, the outer-circumferential cylindrical portion 140, the first extending portion 122, and the second extending portion 142.

As illustrated in FIG. 5, the coupling portion 16 includes a first coupling portion 160 and a second coupling portion 162. At the first coupling portion 160, the first extending portion 122 and the second extending portion 142 are coupled in the first direction D1. At the second coupling portion 162, the first ring portion 120 and the outer-circumferential cylindrical portion 140 are coupled in the first direction D1.

As illustrated in FIG. 5, the fixed body 10 is provided with a plurality of engagement portions 18 that engage the first fixed body portion 12 with the second fixed body portion 14 while the first fixed body portion 12 and the second fixed body portion 14 are coupled. The plurality of engagement portions 18 are disposed along an outer periphery 10*o* of the fixed body 10 when the fixed body 10 is viewed in the first direction D1. In other words, the plurality of engagement portions 18 are disposed along the first coupling portion 160 and the second coupling portion 162 that are exposed to the outer surface 10*s* of the fixed body 10.

The engagement portion 18 includes an engagement frame 180 and an engagement claw 188. The engagement frame 180 is attached to the first fixed body portion 12. The engagement claw 188 is attached to the second fixed body portion 14. However, the engagement frame 180 may be attached to the second fixed body portion 14, and the engagement claw 188 may be attached to the first fixed body portion 12.

The engagement frame 180 includes a first frame piece 182, a second frame piece 184, and a connection piece 186. The first frame piece 182 and the second frame piece 184 each extend upward from the outer periphery 120*a* of the first ring portion 120 of the first fixed body portion 12 or the outer periphery of the first extending portion 122. The connection piece 186 extends in a direction orthogonal to the first direction D1 and along the outer periphery 10*o*, and connects an upper end of the first frame piece 182 and an upper end of the second frame piece 184. The engagement claw 188 is hooked on the connection piece 186 between the first frame piece 182 and the second frame piece 184.

In the present embodiment, the engagement frame 180 is integrally formed with either the first ring portion 120 or the first extending portion 122. The engagement claw 188 is integrally formed with either the outer-circumferential cylindrical portion 140 or the second extending portion 142. However, the engagement portion 18 is not limited to the structure disclosed in the present embodiment. Furthermore, the plurality of engagement portions 18 may be omitted.

Figure 6:
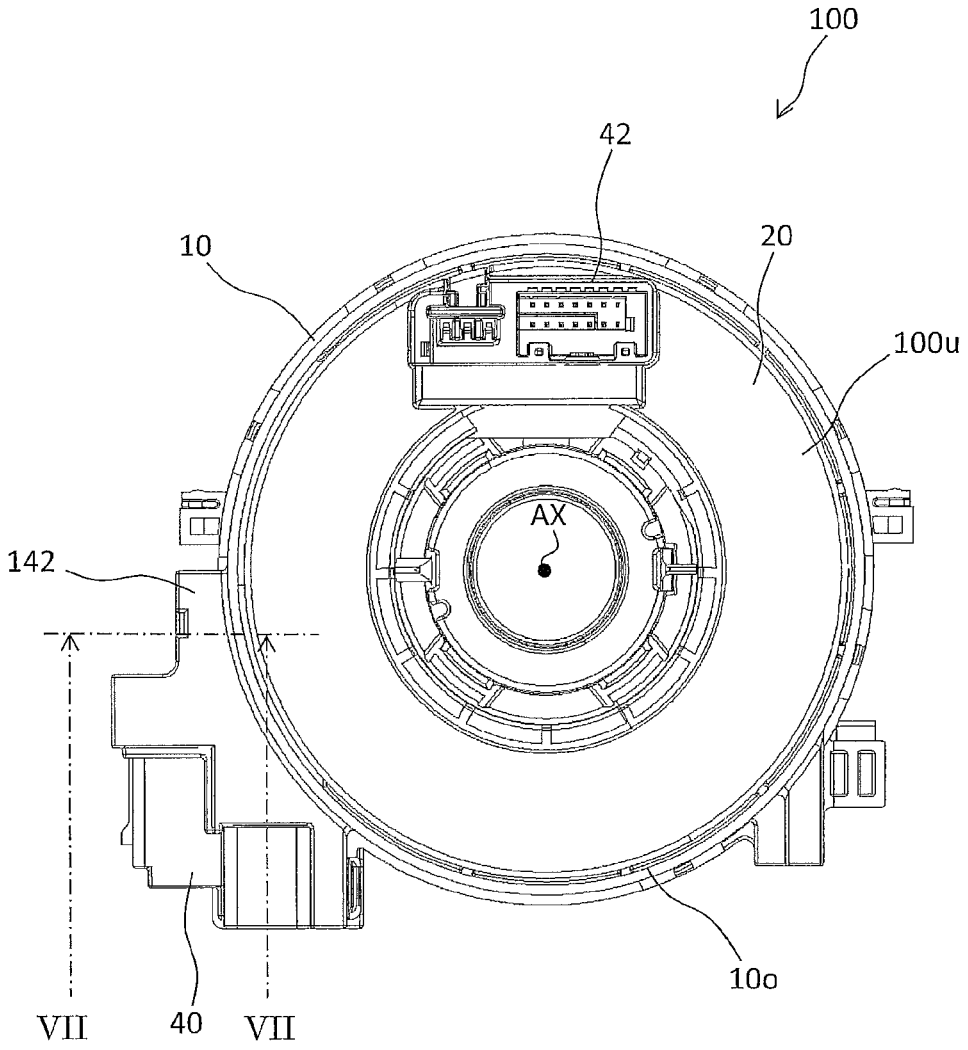
FIG. 6 is a top view of the rotary connector device.
Figure 7:
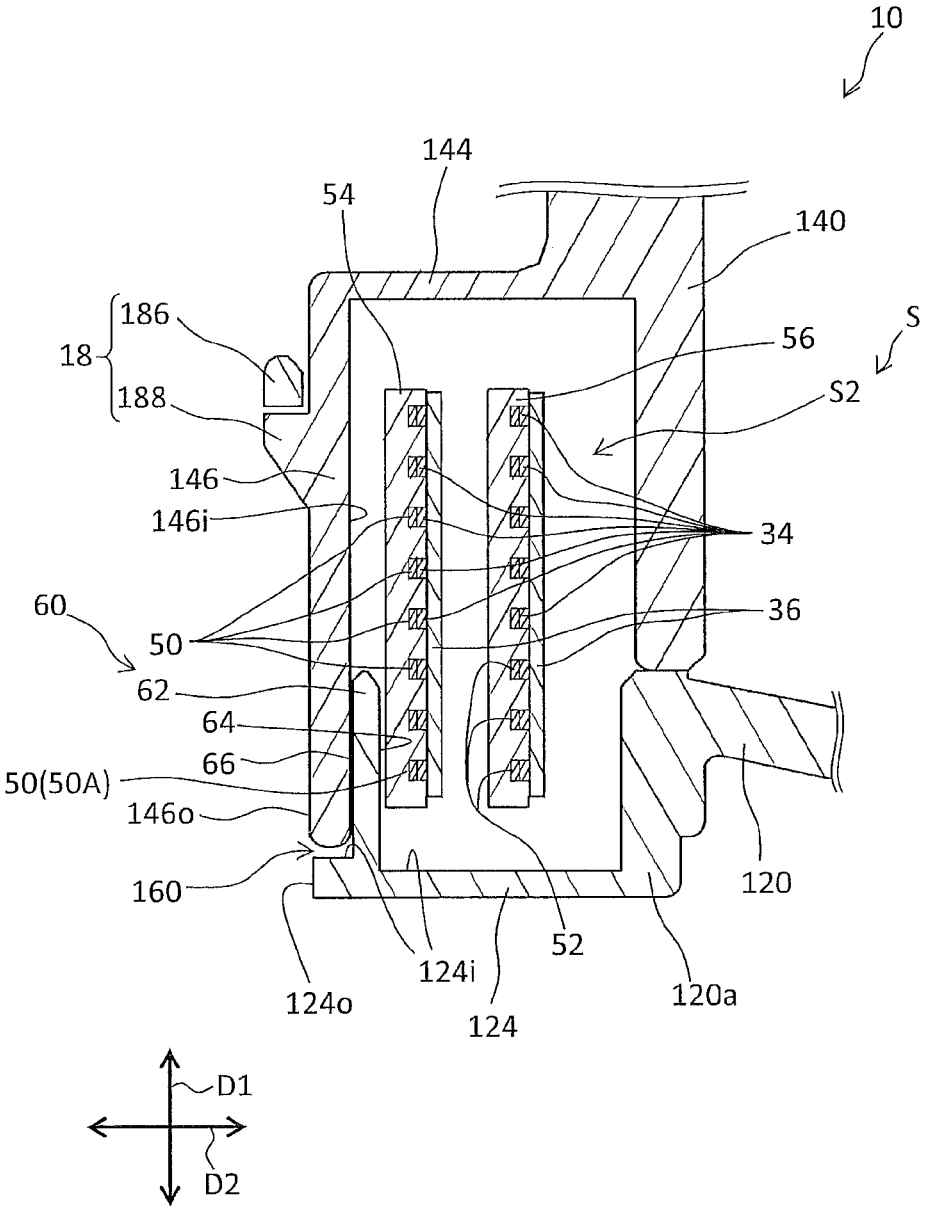
FIG. 7 is a cross-sectional view of the rotary connector device taken along the line VII-VII in FIG. 6.

Details of the first coupling portion 160 will be described with reference to FIGS. 6 and 7. FIG. 6 is a diagram illustrating a top surface 100*u* of the rotary connector device 100. FIG. 7 is a cross-sectional view of the rotary connector device 100 taken along the line VII-VII in FIG. 6.

As illustrated in FIG. 7, the fixed body 10 includes a first wall 124, a second wall 144, and a third wall 146. The first wall 124, the second wall 144, and the third wall 146 define the second space S2. Note that the second space S2 is included in the space S between the first fixed body portion 12 and the second fixed body portion 14. In the present embodiment, the second space S2 is also defined by the outer-circumferential cylindrical portion 140. However, the second space S2 may be defined without the outer-circumferential cylindrical portion 140.

The first wall 124 extends outward from the outer periphery 120*a* of the first ring portion 120 in the radial direction of the rotation axis AX. The second wall 144 extends outward from the outer-circumferential cylindrical portion 140 in the radial direction of the rotation axis AX. The second wall 144 faces the first wall 124 in the first direction D1. The third wall 146 is parallel to the first direction D1 and is connected to the second wall 144. The third wall 146 extends to the first wall 124 in the first direction D1. At the first coupling portion 160, the third wall 146 and the first wall 124 are coupled in the first direction D1. The first coupling portion 160 is exposed to an outer surface 124*o* of the first wall 124 and an outer surface 146*o* of the third wall 146.

In the present embodiment, to define the second space S2, the first extending portion 122 includes the first wall 124, and the second extending portion 142 includes the second wall 144 and the third wall 146. However, the structure for defining the second space S2 is not limited thereto.

As illustrated in FIG. 7, in the second space S2, the insulating supporting body 54 and the insulating supporting body 56 are aligned in a second direction D2 orthogonal to the rotation axis AX. The insulating supporting body 54 is closer to the first coupling portion 160 than the insulating supporting body 56 in the second direction D2. That is, each of the plurality of connection conductors 50 supported by the insulating supporting body 54 is closer to the first coupling portion 160 in the second direction D2 than each of the plurality of connection conductors 52 supported by the insulating supporting body 56.

Inhibiting Structure

The rotary connector device 100 includes an inhibiting structure 60 that inhibits foreign matter from entering the space S through the coupling portion 16. More specifically, as illustrated in FIG. 7, the inhibiting structure 60 includes a protecting member 62 for inhibiting the entry of foreign matter into the second space S2 through the first coupling portion 160.

As illustrated in FIG. 7, the protecting member 62 is disposed between the first coupling portion 160 and the plurality of connection conductors 50. Specifically, the protecting member 62 is disposed such that the first coupling portion 160, the protecting member 62, and each connection conductor 50 overlap when the fixed body 10 is viewed in each direction from the first coupling portion 160 to each connection conductor 50.

For example, the protecting member 62 is disposed such that the first coupling portion 160, the protecting member 62, and a connection conductor 50A, which is the closest connection conductor 50 to the first coupling portion 160, overlap when the fixed body 10 is viewed in a direction from the first coupling portion 160 to the connection conductor 50A.

The protecting member 62 is disposed between the plurality of connection conductors 50 and an engagement portion 18 of the plurality of engagement portions 18 that is closest to the plurality of connection conductors 50. In other words, the protecting member 62 faces the engagement portion 18 closest to the plurality of connection conductors 50 via the third wall 146.

The protecting member 62 extends upward from the first wall 124 in the first direction D1. With this configuration, a gap passageway between the first coupling portion 160 and the plurality of connection conductors 50 is long in the first direction D1. However, the length of the protecting member 62 in the first direction D1 is not limited to the length illustrated in FIG. 7. For example, the length of the protecting member 62 in the first direction D1 may be equal to the length of the protecting member 62 in the second direction D2. The protecting member 62 may extend downward from the second wall 144 in the first direction D1 provided that the protecting member 62 is located between the first coupling portion 160 and the plurality of connection conductors 50.

As illustrated in FIG. 7, the protecting member 62 includes a first surface 64 and a second surface 66 that are parallel with the first direction D1 and that face each other in the second direction D2. The first surface 64 faces the insulating supporting body 54. The second surface 66 faces the first coupling portion 160. The second surface 66 is in contact with an inner surface 124*i* of the first wall 124 and an inner surface 146*i* of the third wall 146 so as to connect the inner surface 124*i* and the inner surface 146*i*. With this configuration, the second surface 66 covers the first coupling portion 160. Note that the inner surface 124*i* and the inner surface 146*i* constitute the inner surface of the fixed body 10. However, the second surface 66 may not be in contact with the inner surface 124*i* and the inner surface 146*i*, or may be in contact with either of the inner surface 124*i* and the inner surface 146*i*.

The protecting member 62 includes an insulating material. In the present embodiment, the protecting member 62 and the first fixed body portion 12 are integrally formed of a resin.

Figure 8:
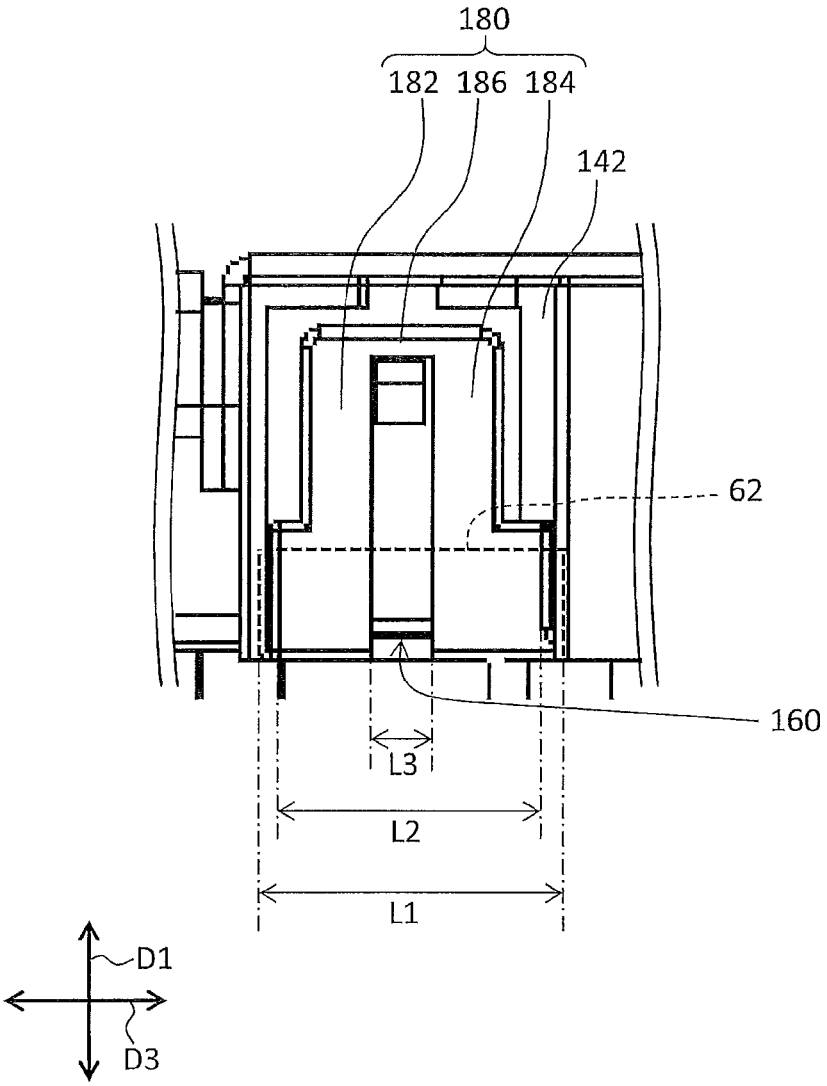
FIG. 8 is a side view of the fixed body for describing the length of a protecting member and the length of an engagement portion.

FIG. 8 is a side view of the fixed body 10 for describing the length of the protecting member 62 and the length of the engagement portion 18. The dotted line in FIG. 8 indicates the protecting member 62.

As illustrated in FIG. 8, the protecting member 62 has a length L1 in a third direction D3. The third direction D3 is orthogonal to the first direction D1 and follows the outer surface 146*o* of the third wall 146. The length L1 of the protecting member 62 in the third direction D3 is greater than a length L2 of the engagement portion 18 in the third direction D3. With this configuration, the gap passageway from the first coupling portion 160 between the first frame piece 182 and the second frame piece 184 to the plurality of connection conductors 50 is long in the third direction D3. However, the length L1 of the protecting member 62 in the third direction D3 is not limited to the example illustrated in FIG. 8. For example, the length L1 of the protecting member 62 in the third direction D3 may be longer than the length L3 of the first coupling portion 160 between the first frame piece 182 and the second frame piece 184 in the third direction D3, or may be shorter than the length L2. In addition, the length L1 in the third direction D3 may be shorter than the length L3 in the third direction D3. Furthermore, the protecting member 62 may be provided along the entire outer circumference of the first extending portion 122 and the second extending portion 142 along the third wall 146.

The rotary connector device 100 includes the cable 30, the cable 32, the first connector 40, and the second connector 42, but the cable 30, the cable 32, the first connector 40, and the second connector 42 may be omitted.

In the present embodiment, the connection conductor 50 is attached to the fixed body 10 by way of the insulating supporting body 54, but the insulating supporting body 54 may be omitted. The connection conductor 50 may be directly attached to the fixed body 10.

In the present embodiment, one protecting member 62 is provided. However, the fixed body 10 may include a plurality of protecting members 62. For example, a plurality of protecting members 62 may be disposed so as to face, via the third wall 146, the plurality of engagement portions 18 arranged in order of proximity to the plurality of connection conductors 50. However, the protecting members 62 need not face the engagement portions 18 via the third wall 146.

Figure 10:
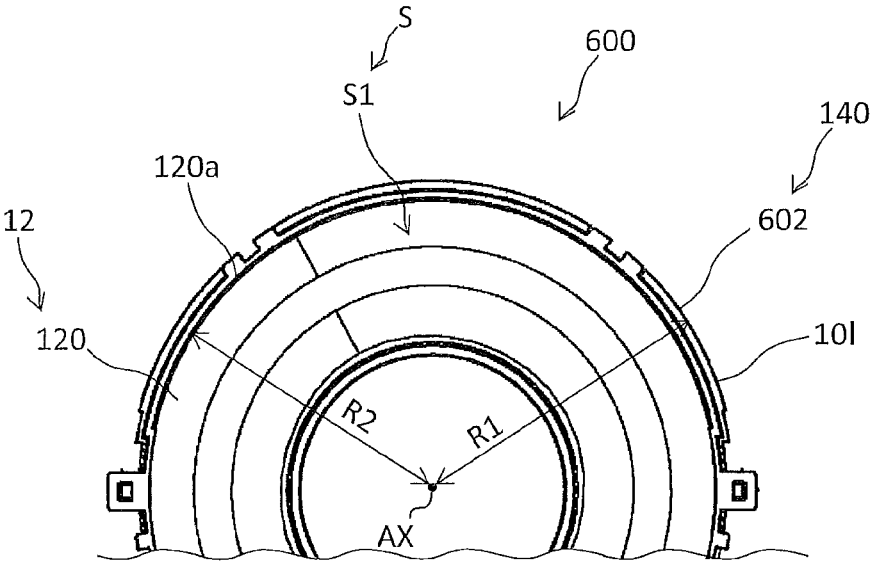
FIG. 10 is a cross-sectional view of a fixed body for illustrating an inhibiting portion.
Figure 11:
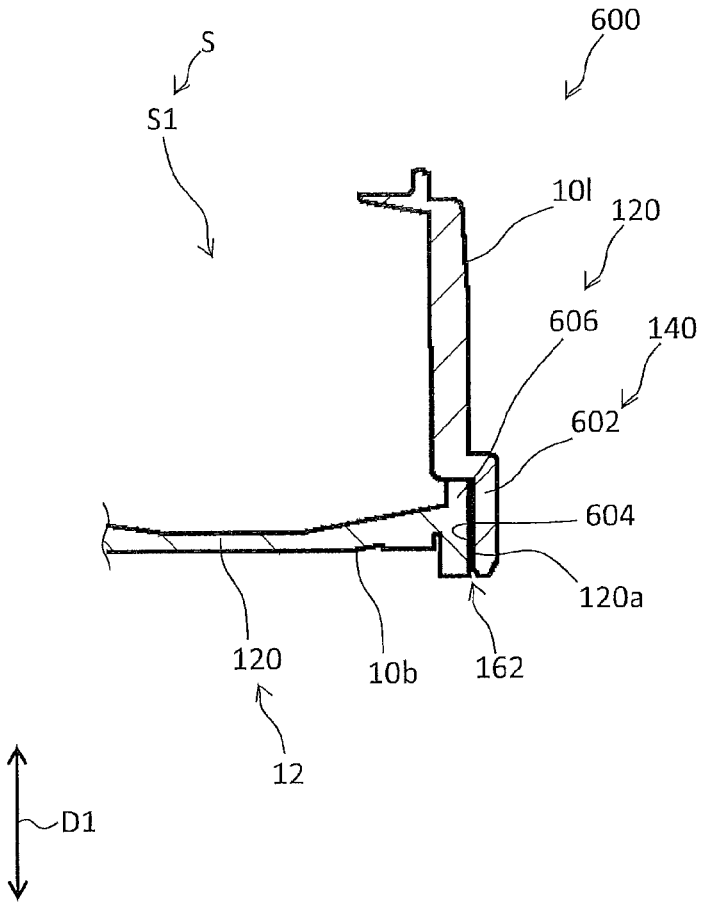
FIG. 11 is a cross-sectional view of a fixed body for illustrating the inhibiting portion.

Further, the inhibiting structure 60 includes an inhibiting portion 600 configured to inhibit the entry of foreign matter into the first space S1 through the second coupling portion 162. FIG. 10 is a cross-sectional view of the fixed body 10 in a plane orthogonal to the rotation axis AX for illustrating the inhibiting portion 600. FIG. 11 is a cross-sectional view of the fixed body 10 in a plane parallel to the radial direction of the rotation axis AX and the first direction D1 for illustrating the inhibiting portion 600.

As illustrated in FIGS. 10 and 11, the inhibiting portion 600 is configured by the outer-circumferential cylindrical portion 140 and the outer periphery 120*a* of the first ring portion 120 coming into contact with each other such that the outer-circumferential cylindrical portion 140 is outside the outer periphery 120*a* in the radial direction of the rotation axis AX. The inhibiting portion 600 is provided separately from the engagement portion 18. In the present embodiment, the outer-circumferential cylindrical portion 140 includes a large diameter portion 602 that is in contact with the outer periphery 120*a* of the first ring portion 120. As illustrated in FIG. 10, a diameter R1 of the large diameter portion 602 is larger than the diameter of the outer-circumferential cylindrical portion 140 anywhere other than at the large diameter portion 602. The diameter R1 of the large diameter portion 602 is larger than a diameter R2 of the outer periphery 120*a*. However, in a case where the diameter of the outer-circumferential cylindrical portion 140 is larger than the diameter R2 of the outer periphery 120*a*, the large diameter portion 602 need not be provided. The outer-circumferential cylindrical portion 140 covers the outer periphery 120*a* of the first ring portion 120 in the radial direction of the rotation axis AX. Thus, the second coupling portion 162 is exposed at the bottom portion 10*b* of the fixed body 10 and is not exposed at the side wall 101 of the fixed body 10.

In addition, the first ring portion 120 includes an extending portion 606 that extends in the first direction D1. The outer periphery 120*a* of the first ring portion 120 is constituted by the outer periphery of the extending portion 606. A surface 604 of the large diameter portion 602 is in contact with the extending portion 606 that extends in the first direction D1. Thus, a pathway from the second coupling portion 162 to the first space S1 is long in the first direction D1. However, the surface 604 need not be in contact with the extending portion 606. Further, the extending portion 606 may be omitted.

Features of First Embodiment

The rotary connector device 100 and features of the rotary connector device 100 are summarized below.

The rotary connector device 100 includes the fixed body 10, the rotation body 20, and the inhibiting structure 60. The fixed body 10 includes the first fixed body portion 12 and the second fixed body portion 14 disposed facing each other with the space S being defined between the first fixed body portion 12 and the second fixed body portion 14, and coupled at the coupling portion 16. The coupling portion 16 is exposed to the outer surface 10*s* of the fixed body 10. The inhibiting structure 60 inhibits foreign matter from entering the space S between the first fixed body portion 12 and the second fixed body portion 14. With this configuration, deterioration of the rotary connector device 100 due to the entry of foreign matter is inhibited. As a result, the environmental resistance of the rotary connector device 100 is improved.

Note that the foreign matter is, for example, fluid water and dust.

The rotary connector device 100 further includes the connection conductor 50 disposed on the fixed body 10 in the second space S2 included in the space S. The connection conductor 50 is connected to a first end of the cable conductor wire 34, and the rotation body 20 is connected to a second end of the cable conductor wire 34.

With this configuration, foreign matter is inhibited from adhering to the connection conductor 50, and the connection conductor 50 is prevented from degrading.

Further, in the rotary connector device 100, the inhibiting structure 60 includes the protecting member 62 configured to increase the length of the gap passageway between the coupling portion 16 and the connection conductor 50. This configuration can inhibit foreign matter from reaching the connection conductor 50.

Further, in the rotary connector device 100, the inhibiting structure 60 includes the protecting member 62 disposed between the coupling portion 16 and the connection conductor 50 in the second space S2 included in the space S. This configuration can inhibit foreign matter from reaching the connection conductor 50.

Further, in the rotary connector device 100, the protecting member 62 is in contact with at least one of the inner surface 124*i* of the first fixed body portion 12 and the inner surface 146*i* of the second fixed body portion 14 at the coupling portion 16. With this configuration, entry of foreign matter is inhibited because the protecting member 62 is disposed to fill the coupling portion 16.

In the rotary connector device 100, the rotation body 20 is rotatable about the rotation axis AX in the first direction D1. The coupling portion 16 is provided on the outer periphery 10*o* of the fixed body 10 when viewed in the first direction D1. The protecting member 62 is disposed between the coupling portion 16 and the connection conductor 50 in the second direction D2 orthogonal to the first direction D1. The protecting member 62 extends from the first fixed body portion 12 in the first direction D1. This configuration inhibits foreign matter from flowing around the protecting member 62 because the gap passageway between the coupling portion 16 and the connection conductor 50 extends in the first direction D1.

In the rotary connector device 100, the fixed body 10 includes the engagement portion 18 configured to engage the first fixed body portion 12 and the second fixed body portion 14. In the second direction D2, the protecting member 62 is disposed between the engagement portion 18 and the connection conductor 50. With this configuration, even in a case where foreign matter is more likely to enter at the coupling portion 16 in the vicinity of the engagement portion 18, the protecting member 62 is disposed corresponding to the coupling portion 16 at the position where foreign matter is likely to enter. Thus, this configuration can effectively inhibit the entry of foreign matter.

In the rotary connector device 100, the length L1 of the protecting member in the third direction D3 orthogonal to the first direction D1 and following the outer surface 10*s* of the fixed body 10 is longer than the length L2 of the engagement portion 18 in the third direction D3. This configuration can inhibit foreign matter from flowing around the protecting member 62 that is long in the third direction D3, even in a case where foreign matter enters at the coupling portion 16 in the vicinity of the engagement portion 18.

In the rotary connector device 100, the engagement portion 18 includes the engagement frame 180 attached to one of the first fixed body portion 12 and the second fixed body portion 14, and the engagement claw 188 attached to the other of the first fixed body portion 12 and the second fixed body portion 14. Even in a case where engagement between the engagement frame 180 and the engagement claw 188 loosens, the protecting member 62 is disposed corresponding to the engagement portion 18, and thus this configuration can effectively inhibit the entry of foreign matter.

In the rotary connector device 100, the protecting member 62 includes an insulating material. With this configuration, even in a case where the protecting member 62 is in contact with the connection conductor 50, electrical connection problems such as short-circuiting can be inhibited.

The rotary connector device 100 includes the first connector 40 provided on the outside of the fixed body 10 and including the first terminal 400 electrically connected to the connection conductor 50. This configuration improves connectivity between the rotary connector device 100 and an external cable.

The rotary connector device 100 includes the insulating supporting body 54 that supports the connection conductor 50 and is attached to the fixed body 10 in the space S. This configuration can inhibit electrical connection problems such as short-circuiting between the connection conductor 50 and another conductor.

In the rotary connector device 100, the space S includes the first space S1 and the second space S2. The rotation body 20 is disposed corresponding to the first space S1. The connection conductor 50 is disposed in the second space S2.

The cable 30 includes the cable conductor wire 34 and the insulating covering member 36 covering the cable conductor wire 34. The cable 30 is disposed in a space (first space S1) between the rotation body 20 and the fixed body 10.

The inhibiting structure 60 includes the inhibiting portion 600 configured by the second fixed body portion 14 covering the first fixed body portion 12 in the radial direction of the rotation axis AX.

Therefore, foreign matter entering from the outside in the radial direction of the rotation axis AX is inhibited from entering the first space S1 included in the space S.

Further, in the radial direction of the rotation axis AX, the surface 604 of the second fixed body portion 14 and the outer periphery 120*a* of the first ring portion 120 of the first fixed body portion 12 are in contact with each other.

Because the passageway between the second coupling portion 162 and the first space S1 is narrow, foreign matter can be effectively inhibited from entering the first space S1.

Second Embodiment

Figure 9:
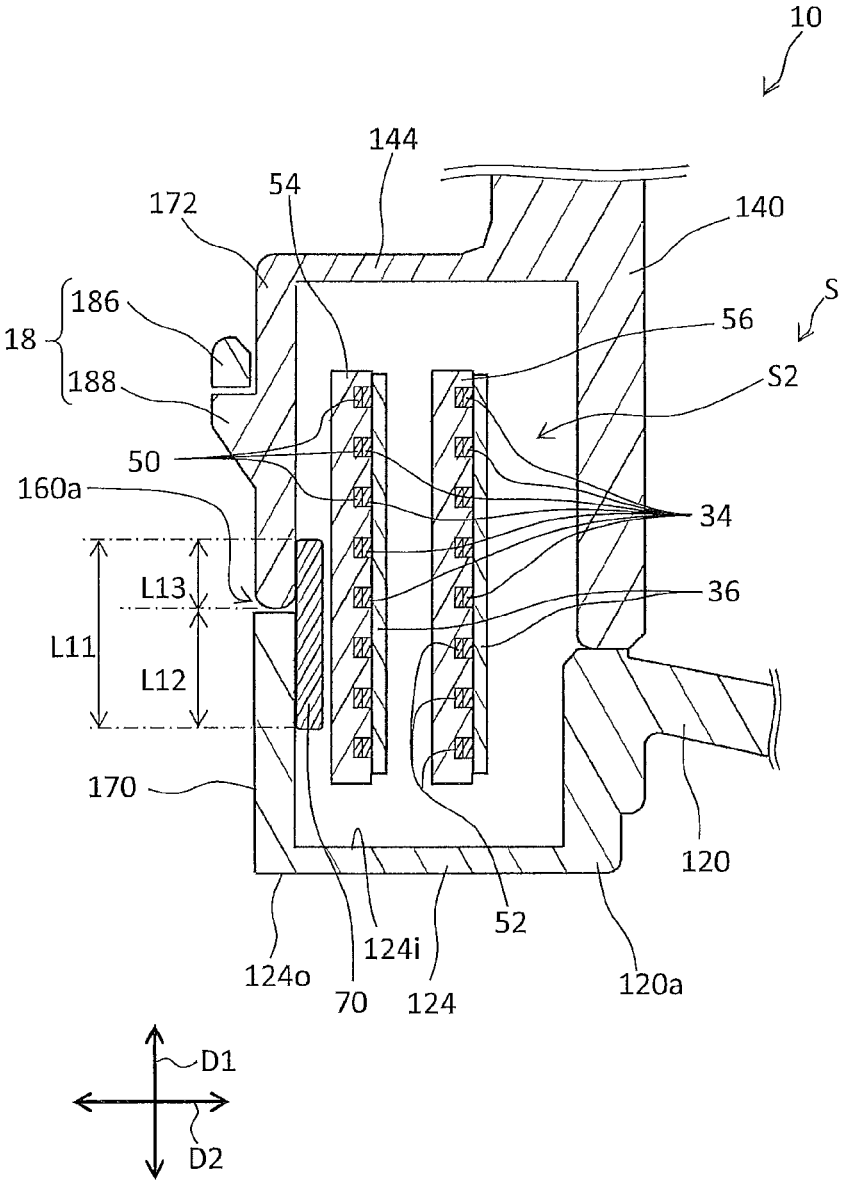
FIG. 9 is a cross-sectional view of a rotary connector device according to a second embodiment.

Next, a rotary connector device according to a second embodiment will be described with reference to FIG. 9. FIG. 9 is a cross-sectional view corresponding to the cross-sectional view illustrated in FIG. 7.

The rotary connector device according to the second embodiment differs from the rotary connector device 100 according to the first embodiment in terms of the structure defining the second space S2 and the configuration of a protecting member 70 (corresponds to the protecting member 62). Descriptions of identical configurations are omitted.

As illustrated in FIG. 9, the second space S2 is defined by the first wall 124, the second wall 144, a third wall 170, and a fourth wall 172. The third wall 170 extends upward from the first wall 124. The fourth wall 172 extends downward from the second wall 144. An upper end of the third wall 170 and a lower end of the fourth wall 172 are coupled at a first coupling portion 160*a*. In other words, the first coupling portion 160*a* is separated from the first wall 124 and the second wall 144 in the first direction D1.

The protecting member 70 differs from the protecting member 62 in terms of position in the first direction D1. Further, unlike the protecting member 62, the protecting member 70 is provided separately from the first wall 124. As illustrated in FIG. 9, the protecting member 70 is separated from the first wall 124 and the second wall 144 in the first direction D1 so as to face the first coupling portion 160*a*. A length L11 of the protecting member 70 in the first direction D1 includes a length L12 from a position facing the first coupling portion 160*a* in the second direction D2 to a lower end of the protecting member 70, and a length L13 from a position facing the first coupling portion 160*a* in the second direction D2 to an upper end of the protecting member 70. The length L12 is longer than the length L13. With this configuration, the gap passageway extending from the first coupling portion 160*a* to the plurality of connection conductors 50 around a lower portion of the protecting member 70 is longer than a gap passageway extending from the first coupling portion 160*a* to the plurality of connection conductors 50 around an upper portion of the protecting member 70. Therefore, this configuration effectively inhibits foreign matter from reaching the plurality of connection conductors 50, even in a case where foreign matter that has entered through the first coupling portion 160*a* easily moves downward.

The length L11, the length L12, and the length L13 of the protecting member 70 are not limited to those illustrated in FIG. 9.

Note that in the present application, "comprise" and derivatives thereof are non-limiting terms describing the presence of components and do not preclude the presence of other components not described. This also applies to "have", "include", and derivatives thereof.

In the present application, a number such as "first" or "second" is merely a term for identifying a configuration, and does not have any other meaning (e.g., a particular order, etc.). The presence of, for example, a "first element" does not imply that a "second element" exists, and the presence of a "second element" does not imply that a "first element" exists.

Expressions such as "parallel", "orthogonal", and "identical" in the present disclosure should not be interpreted strictly and include the meanings of "substantially parallel", "substantially orthogonal", and "substantially identical". Further, representations of other arrangements are not to be strictly interpreted.

Various alterations and modifications of the disclosure are apparent from the foregoing disclosure. Accordingly, the disclosure may be implemented in a manner different from the specific disclosure of the present application without departing from the spirit of the disclosure.

Obviously, numerous modifications and variations of the present invention are possible in light of the above teachings. It is therefore to be understood that within the scope of the appended claims, the invention may be practiced otherwise than as specifically described herein.

What is claimed is:

1. A rotary connector device comprising:

a fixed body including a first fixed body portion and a second fixed body portion, the first fixed body portion and the second fixed body portion being coupled at a coupling portion;

a rotation body rotatably assembled to the fixed body;

a cable including a cable conductor wire and an insulating covering member covering the cable conductor wire, the cable being disposed in a space defined between the fixed body and the rotation body;

a connection conductor disposed on the fixed body in the space, the connection conductor being connected to a first end of the cable conductor wire, the rotation body being connected to a second end of the cable conductor wire; and an inhibiting structure configured to inhibit foreign matter from entering the space through the coupling portion, the coupling portion being exposed to an outer surface of the fixed body, and the inhibiting structure including a protecting member disposed between the coupling portion and the connection conductor in the space.

2. The rotary connector device according to claim 1, wherein the protecting member is configured to increase a length of a gap passageway between the coupling portion and the connection conductor.

3. The rotary connector device according to claim 1, wherein the protecting member is in contact with at least one of an inner surface of the first fixed body portion and an inner surface of the second fixed body portion at the coupling portion.

4. The rotary connector device according to claim 1, wherein the protecting member includes an insulating material.

5. The rotary connector device according to claim 1, wherein the space includes a first space and a second space, the rotation body is disposed corresponding to the first space, the first space is defined between the fixed body and the rotation body, the second space is defined between the first fixed body portion and the second fixed body portion, the cable is disposed in the first space, and the connection conductor is disposed in the second space.

6. The rotary connector device according to claim 1, wherein the protecting member includes a first surface and a second surface provided on a reverse side of the first surface, the first surface faces the connection conductor, and the second surface faces the coupling portion.

7. The rotary connector device according to claim 1, wherein the rotation body is rotatable relative to the fixed body about a rotational axis, the first fixed body portion includes a first wall extending radially with respect to the rotational axis, the second fixed body portion includes a second wall extending radially with respect to the rotational axis, the second wall being spaced apart from the first wall in a first direction defined along the rotational axis, the space is at least partially defined between the first wall and the second wall in the first direction, one of the first fixed body portion and the second fixed body portion includes a third wall extending from one of the first wall and the second wall toward the other of the first wall and the second wall in the first direction, and the protecting member is provided between the third wall and the connection conductor.

8. The rotary connector device according to claim 1, further comprising:

a first connector disposed outside the fixed body and including a terminal electrically connected to the connection conductor.

9. The rotary connector device according to claim 8, wherein the first connector is partially disposed in the space.

10. The rotary connector device according to claim 1, further comprising:

an insulating supporting body configured to support the connection conductor and attached to the fixed body in the space.

11. The rotary connector device according to claim 10, wherein the protecting member is disposed between the coupling portion and the insulating supporting body in the space.

12. The rotary connector device according to claim 1, wherein the inhibiting structure includes an inhibiting portion configured by the second fixed body portion covering the first fixed body portion in a radial direction of the rotation axis of the rotation body.

13. The rotary connector device according to claim 12, wherein a surface of the second fixed body portion is in contact with an outer periphery of the first fixed body portion in the radial direction.

14. The rotary connector device according to claim 1, wherein the fixed body includes an engagement portion configured to engage the first fixed body portion and the second fixed body portion with each other, and the protecting member is disposed between the engagement portion and the connection conductor.

15. The rotary connector device according to claim 14, wherein the rotation body is rotatable relative to the fixed body about a rotational axis, the engagement portion includes:

an engagement frame attached to one of the first fixed body portion and the second fixed body portion; and an engagement claw attached to the other of the first fixed body portion and the second fixed body portion, the engagement frame includes a first frame piece, a second frame piece, and a connection piece, the first frame piece and the second frame piece each extend from the first fixed body portion in a first direction defined along the rotational axis, the second frame piece being spaced apart from the first frame piece in a direction orthogonal to the first direction and along an outer periphery of the fixed body, the connection piece extends between the first frame piece and the second frame piece in the direction to connect the first frame piece and the second frame piece, the engagement claw is hooked on the connection piece between the first frame piece and the second frame piece, the protecting member has a length defined in the first direction, and the length of the protecting member is longer than a length of the coupling portion between the first frame piece and the second frame piece in the direction.

16. The rotary connector device according to claim 1, wherein the rotation body is rotatable about a rotation axis along a first direction, the coupling portion is provided on an outer periphery of the fixed body when viewed in the first direction, the protecting member is disposed between the coupling portion and the connection conductor in a second direction substantially orthogonal to the first direction, and the protecting member extends from the first fixed body portion or the second fixed body portion in the first direction.

17. The rotary connector device according to claim 16, wherein the fixed body includes an engagement portion configured to engage the first fixed body portion and the second fixed body portion with each other, and the protecting member is disposed between the engagement portion and the connection conductor in the second direction.

18. The rotary connector device according to claim 17, wherein a length of the protecting member in a third direction substantially orthogonal to the first direction and following the outer surface is longer than a length of the engagement portion in the third direction.

19. The rotary connector device according to claim 17, wherein the engagement portion includes:

an engagement frame attached to one of the first fixed body portion and the second fixed body portion; and an engagement claw attached to the other of the first fixed body portion and the second fixed body portion.

20. A fixed body for a rotary connector device, comprising:

a first fixed body portion;

a second fixed body portion coupled to the first fixed body portion at a coupling portion; and an inhibiting structure configured to inhibit foreign matter from entering, through the coupling portion, a space defined between the fixed body and a rotation body of the rotary connector device in a state where the rotation body is rotatably assembled to the first fixed body portion and the second fixed body portion, the coupling portion being exposed to an outer surface of the first fixed body portion and the second fixed body portion, and the inhibiting structure including a protecting member disposed between the coupling portion and a connection conductor in the space in a state where the connection conductor connected to a first end of a cable conductor wire of a cable disposed in the space is disposed on the fixed body in the space.

* * * * *